US008544945B2

(12) United States Patent
King

(10) Patent No.: US 8,544,945 B2
(45) Date of Patent: Oct. 1, 2013

(54) ARMREST CONSTRUCTION AND METHOD

(75) Inventor: Sheldon King, Sydney (AU)

(73) Assignee: The Product People Pty. Limited, Sydney NSW (AU)

( * ) Notice: Subject to any disclaimer, the term of this patent is extended or adjusted under 35 U.S.C. 154(b) by 253 days.

(21) Appl. No.: 13/149,210

(22) Filed: May 31, 2011

(65) Prior Publication Data

US 2011/0298252 A1 Dec. 8, 2011

(30) Foreign Application Priority Data

Jun. 4, 2010 (AU) ..... 2010902457

(51) Int. Cl.
*A47C 7/62* (2006.01)

(52) U.S. Cl.
USPC ..... 297/188.14; 297/335; 297/411.33

(58) Field of Classification Search
USPC ..... 297/14, 39, 188.14, 323, 332, 333, 297/335, 411.33, 411.44
See application file for complete search history.

(56) References Cited

U.S. PATENT DOCUMENTS

| | | | | |
|---|---|---|---|---|
| 293,384 | A * | 2/1884 | Wakefield | 297/323 |
| 523,287 | A * | 7/1894 | Kollenberg | 297/332 |
| 997,108 | A * | 7/1911 | Alexander | 297/169 |
| 1,219,960 | A * | 3/1917 | Lagerstrom | 297/334 |
| 1,239,185 | A * | 9/1917 | Hunt | 297/334 |
| 1,964,443 | A * | 6/1934 | Townsend | 297/323 |
| 5,302,000 | A | 4/1994 | Ayotte | |
| 5,791,729 | A * | 8/1998 | McCormick et al. | 297/14 |
| 6,341,821 | B1 * | 1/2002 | Rousseau | 297/411.36 |
| 6,361,105 | B1 * | 3/2002 | Turner et al. | 297/23 |
| 7,530,632 | B2 * | 5/2009 | Kaloustian et al. | 297/188.14 |

FOREIGN PATENT DOCUMENTS

| | | | |
|---|---|---|---|
| EP | 1654960 | A1 | 5/2006 |
| EP | 2223632 | A1 | 9/2010 |
| WO | WO-99/36645 | A1 | 7/1999 |
| WO | WO-2009/027552 | A1 | 3/2009 |

OTHER PUBLICATIONS

Extended European Search Report, EP Application No. 11004535.8, dated Jul. 27, 2011.

* cited by examiner

*Primary Examiner* — Peter Brown
(74) *Attorney, Agent, or Firm* — Novak Druce Connolly Bove + Quigg LLP

(57) ABSTRACT

A chair 10 for seating in rows is disclosed. In particular, an armrest arrangement 21 for such chairs is disclosed. The arrangement has an arm support 22 which is pivoted to a support brace 23. When the seat 15 is pivoted into its standby position the arm support 22 and support brace 23 lie alongside each other and have a transverse width D6 which is less than the front to rear dimension D5 of the adjacent seat 15 and backrest 14. In particular, the armrest arrangement can be provided with a cup holder 145 which remains horizontal, notwithstanding the pivoting action of the chair armrest arrangement. This reduces the incidence of beverage and food spillage.

5 Claims, 14 Drawing Sheets

ARMREST CONSTRUCTION AND METHOD

FIELD OF THE INVENTION

The present invention relates to seating and in particular, to seating arranged in rows such as cinema seating, auditorium seating and stadium seating. Normally such seating is provided with a seat and a backrest.

BACKGROUND ART

Traditionally, in order to increase the seating capacity the distance between adjacent rows in reduced to a minimum. In practice, in order to ensure a sufficient aisle width to allow for safe evacuation in the event of an emergency, such as a fire, this means that the seats must be pivoted between a substantially horizontal use position and a substantially vertical standby position. The seats are normally automatically raised into the standby position by a spring mechanism or the like to improve ingress and egress along the aisles formed between adjacent rows.

The comfort, and hence the length of time during which sitting persons are attentive, of such seating is able to be considerably increased by the provision of armrests.

Armrests preferably should not protrude into the aisle space and for this reason in relation to such seating the conventional armrest has a cantilever configuration and pivots in a vertical plane about a horizontal axis and can thus be swung away into a space between adjacent backseats.

GENESIS OF THE INVENTION

The genesis of the present invention is a desire to provide an alternative armrest arrangement for such seating.

SUMMARY OF THE INVENTION

In accordance with a first aspect of the present invention there is disclosed a pivotal armrest for seating arranged in rows and having a stationary backrest and a seat pivotable between a generally horizontal use position and a generally vertical standby position, said armrest comprising an arm support and a supporting brace each of which has two ends, a first one of said arm support ends being pivotally connectable to one side of said backrest at a location above the axis of pivot of said seat, a first one of said supporting brace ends being pivotally connectable to the same side of said seat at a location thereon spaced from said seat pivot axis, and the second ends of said arm support and said supporting brace being pivotally connected together, the lengths of said arm support and said supporting brace and the distance between said seat pivot axis and said locations being selected such that with said seat pivoted into said use position said armrest support is substantially horizontal and said supporting brace is inclined forwardly, and with said seat pivoted into said standby position said arm support and said supporting brace lie alongside each other and are generally vertical.

In accordance with a second aspect of the present invention there is disclosed a method of moving an armrest between stowed and deployed positions, said method comprising the steps of:

(i) providing an arm support and a supporting brace each having two ends, (ii) pivoting one end of said arm support to one side of a backrest, (iii) pivoting one end of said supporting brace to the same side of a seat pivoted to said backrest and movable between a generally horizontal use position and a generally vertical standby position, and (iv) pivotally interconnecting the second ends of said arm support and said supporting brace.

Preferably the armrest arrangement comprises of a single armrest for each chair or seat of a row of chairs, whereby a person sitting on one chair is able to utilize the armrests on two adjacent chairs. The total number of armrests in a row is thus one more than the number of seats in the row. Alternatively, each chair can have two armrests.

Furthermore, it is also desirable to provide a cup holder in armrests so that cups of beverages, popcorn, chips, and the like can be retained in the cup holder. Naturally a conventional cantilever pivotable armrest if provided with a cup holder can result in spillages which occur, both unintentionally and intentionally, as the armrest is pivoted in a vertical plane between a horizontal deployed position and a vertical and raised standby or storage position.

According to a third aspect of the present invention there is disclosed the abovementioned armrest provided with a generally horizontal cup holder which is maintained substantially horizontal irrespective of movement of the seat between its use and standby positions.

BRIEF DESCRIPTION OF THE DRAWINGS

Two embodiments of the present invention will now be described, by way of example only, with reference to the accompanying drawings in which.

DETAILED DESCRIPTION

Figure 1:
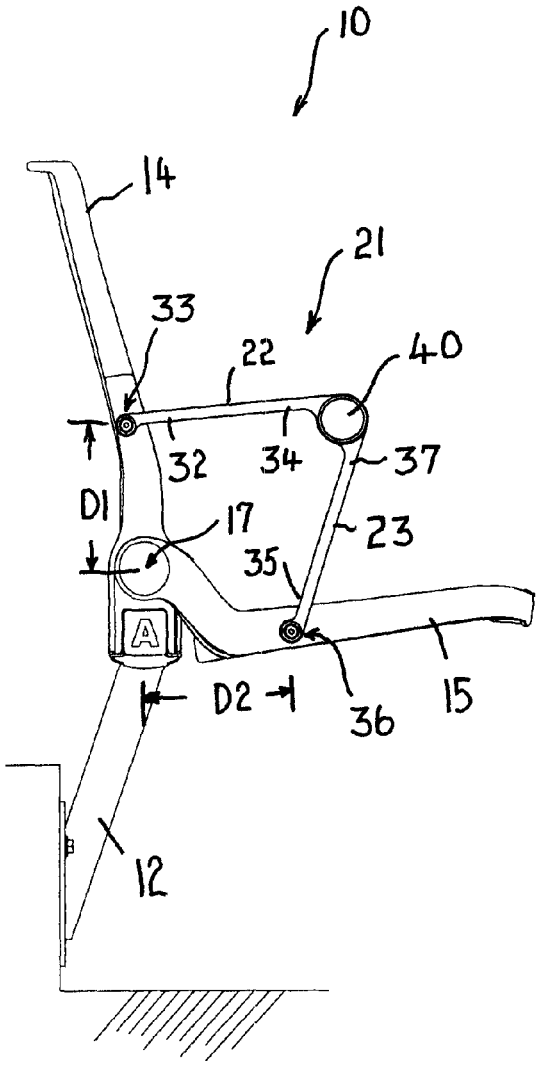
FIG. 1 is a side elevation of the stadium seat of the preferred embodiment with the seat illustrated in the use position.

As seen in FIGS. 1-9, a stadium seat or chair 10 is mounted on a spine 11 which is supported by one or more upstands 12. The chair 10 is only one of a row of similar chairs (not illustrated). The chair 10 has a backrest 14 and a seat 15. The seat 15 is able to be pivoted between a raised storage position illustrated in FIGS. 3 and 4 and a horizontal use position illustrated in FIGS. 1 and 2. Positioned one of either side of the chair 10 is a pair of armrests 21. Each armrest 21 has an arm support 22 and a support brace 23 each of which has two ends.

As seen in FIG. 1, the rearward end 32 of the arm support 22 is pivoted on one side of the backrest 14 at a location 33 which is at a distance D1 above the axis 17 about which the seat 15 pivots. The lower end 35 of the support brace 23 is pivoted to the seat 15 at the same side of the chair 10 at a location 36 which is at a distance D2 from the seat pivot axis 17.

The forward end 34 of the arm support 22 and the upper end 37 of the supporting brace 23 are pivotally connected together at connection 40.

Figure 2:
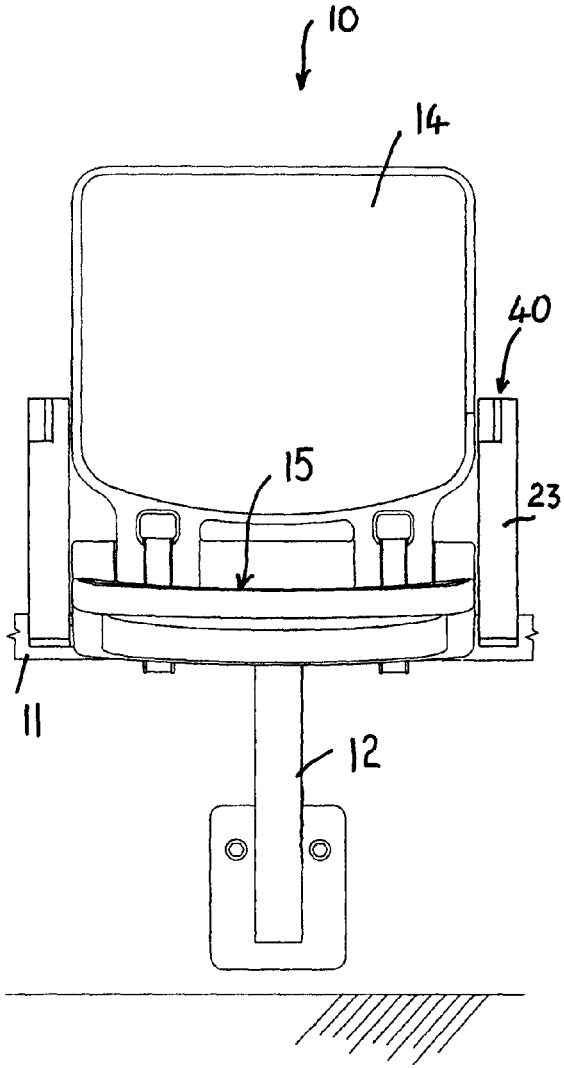
FIG. 2 is a front elevation of the stadium seat of FIG. 1.

As seen in FIGS. 1 and 2, with the seat 15 in the use position, the armrest is deployed with the arm support 22 being generally horizontal and the support brace 23 being inclined forwardly. However, as seen in FIGS. 3 and 4, with the seat 15 in the standby position, the armrest 21 is stowed with the arm support 22 and support brace 23 lying alongside each other and being generally vertical.

Figure 3:
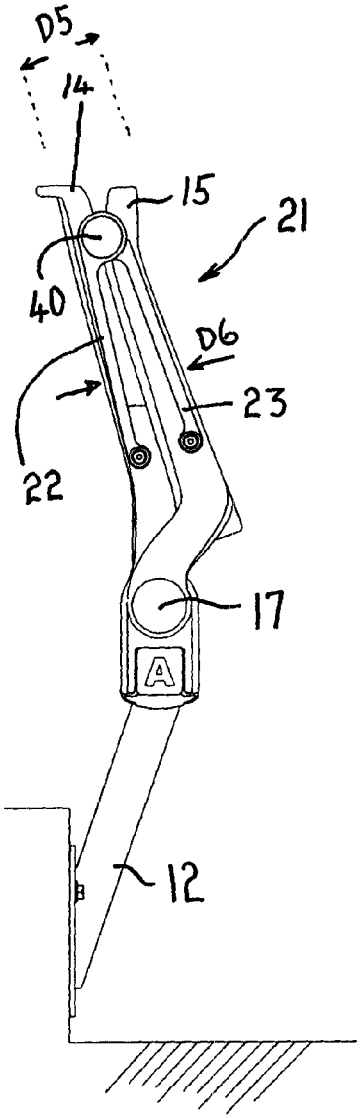
FIG. 3 is a side elevation of the stadium seat of FIG. 1 but with the seat in the raised standby position.
Figure 4:
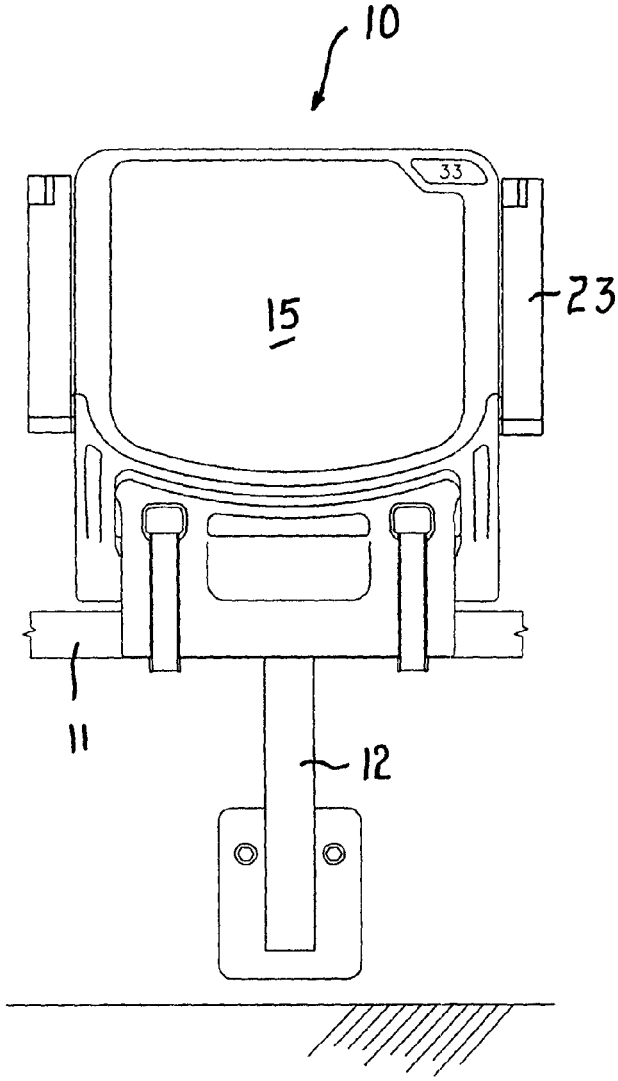
FIG. 4 is a front elevation of the seat of FIG. 3.
Figure 5:
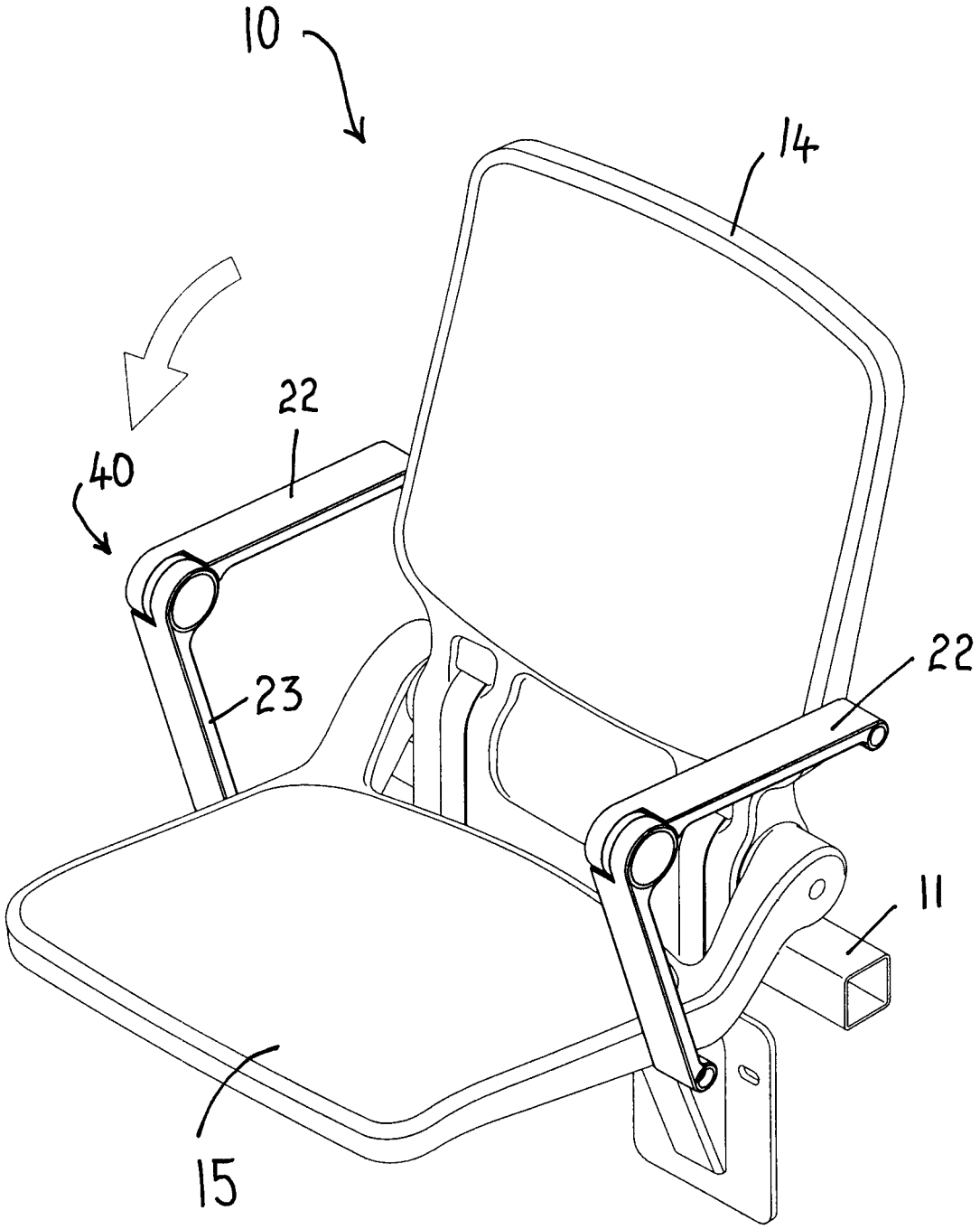
FIG. 5 is a perspective view from the front of the stadium seat of FIGS. 1-4 showing the seat being moved into the generally horizontal use position.

In particular, as seen in FIG. 3, the distance D5 between the rear of the backrest 14 and the underside of the seat 15 exceeds the transverse dimension D6 across the adjacent arm support 22 and support brace 23. Furthermore, the backrest 14 is slightly rearwardly inclined and in the stowed position illustrated in FIG. 3, so too is the armrest 21. The distances D1 and D2 and the lengths of the arm support 22 and support brace 23 are selected to bring about the abovementioned arrangement.

Figure 6:
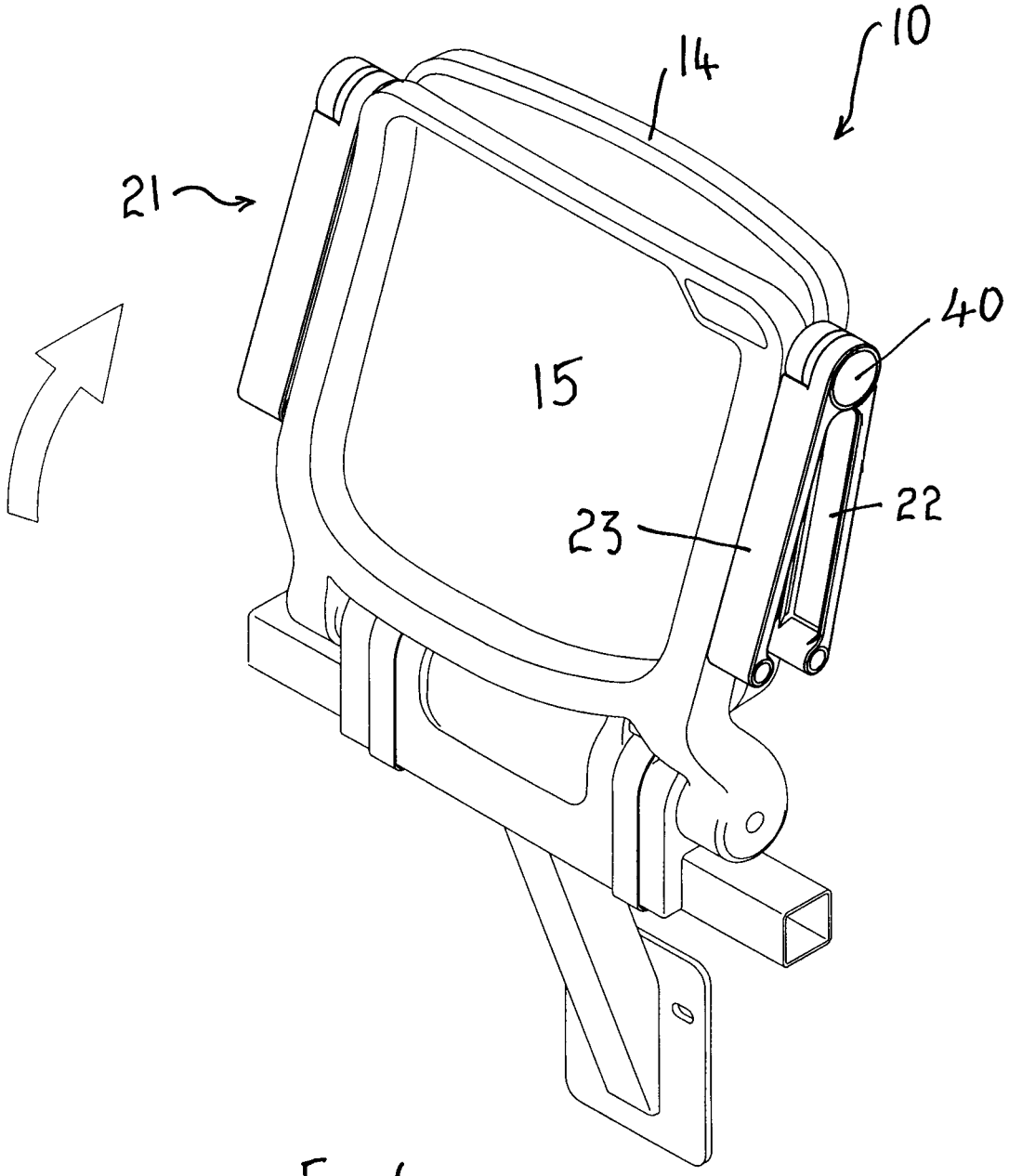
FIG. 6 is a perspective view from the front of the seat of FIG. 5 showing the seat being moved into the generally vertical standby position.

It will be appreciated by those skilled in the art that in the stowed position illustrated in FIGS. 3 and 6, the armrest 21 lies between raised seats 15 and thus does not obstruct the aisle which constitutes the space immediately in front of the chairs 10.

Figure 9:
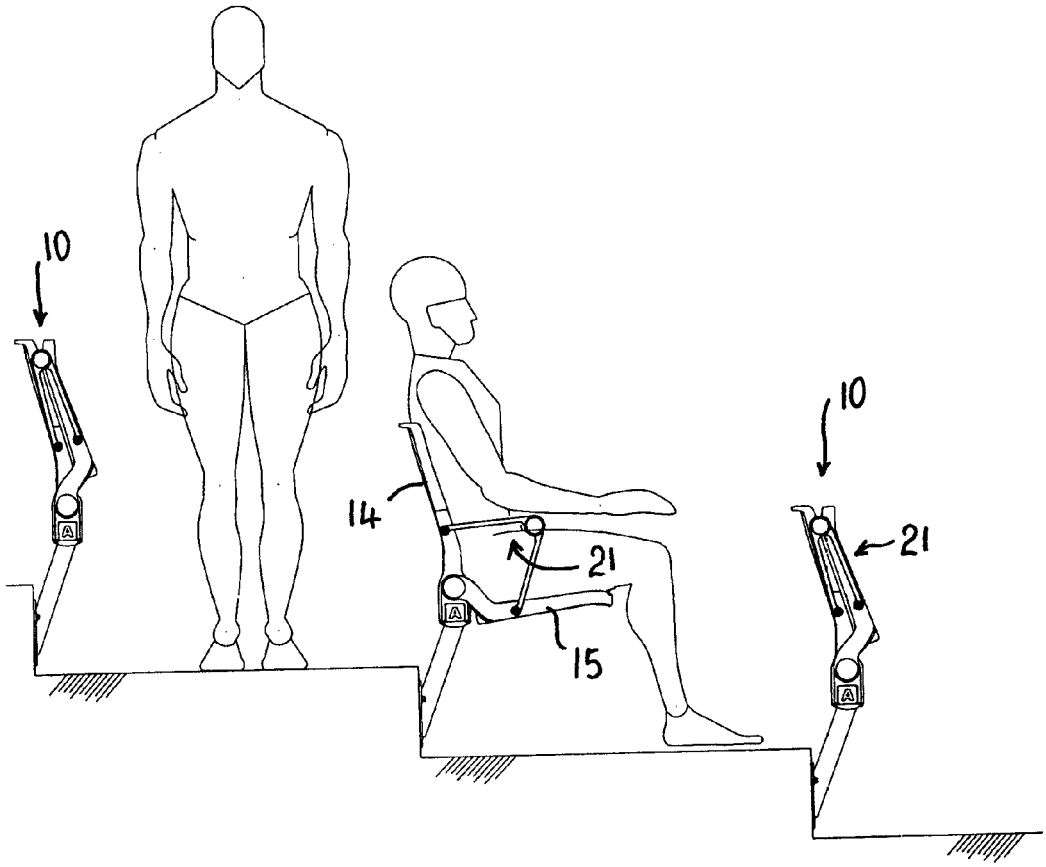
FIG. 9 is a side elevation of three rows of seats showing the seat of the intermediate row in the use configuration and showing the aisle width between adjacent rows, and FIGS. 10-18 repeat FIGS. 1-9 but illustrate an armrest incorporating a cup holder.

In FIG. 9 three rows of the chairs 10 can be seen with two users being illustrated, one standing in an aisle and the other sitting on a chair 10. At the conclusion of the lecture, film, performance, or the like, in order to place the armrests 21 into the stowed position illustrated in FIGS. 3 and 6, it is necessary only to raise the seat 15 (which is normally accomplished by a return spring but is able to be done manually).

It will also be appreciated from FIG. 9 that when the armrests 21 are all in the stowed configuration illustrated in FIG. 3, the entire row of FIG. 9 is clear for the purposes of ingress and egress as illustrated by the standing person in FIG. 9.

Figure 7:
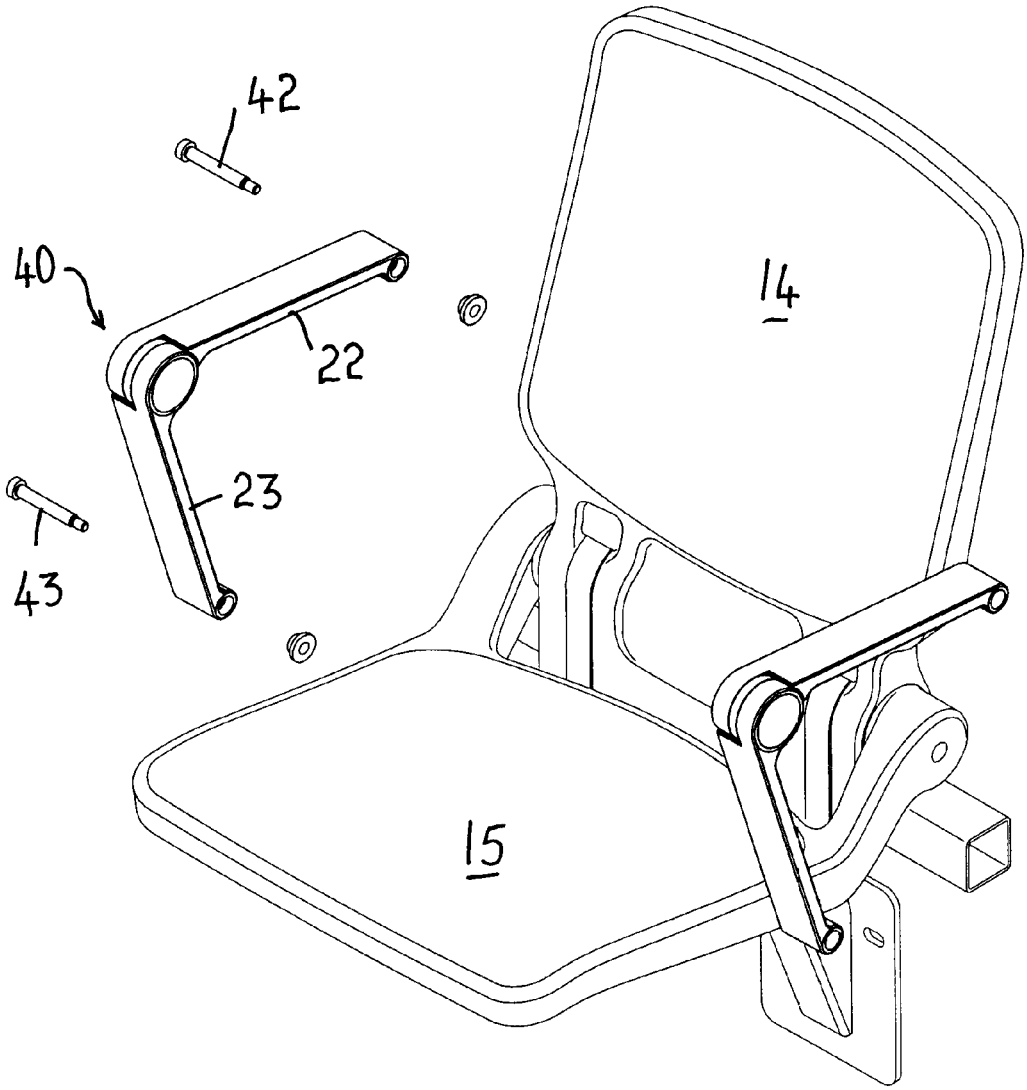
FIG. 7 is a view similar to FIG. 5 but illustrating one of the armrests in an exploded perspective view.

Turning now to FIG. 7, the arm support 22 and support brace 23 are able to pivot about bolts 42 and 43 respectively which threadably engage the backrest 14 and seat 15 respectively.

Figure 8:
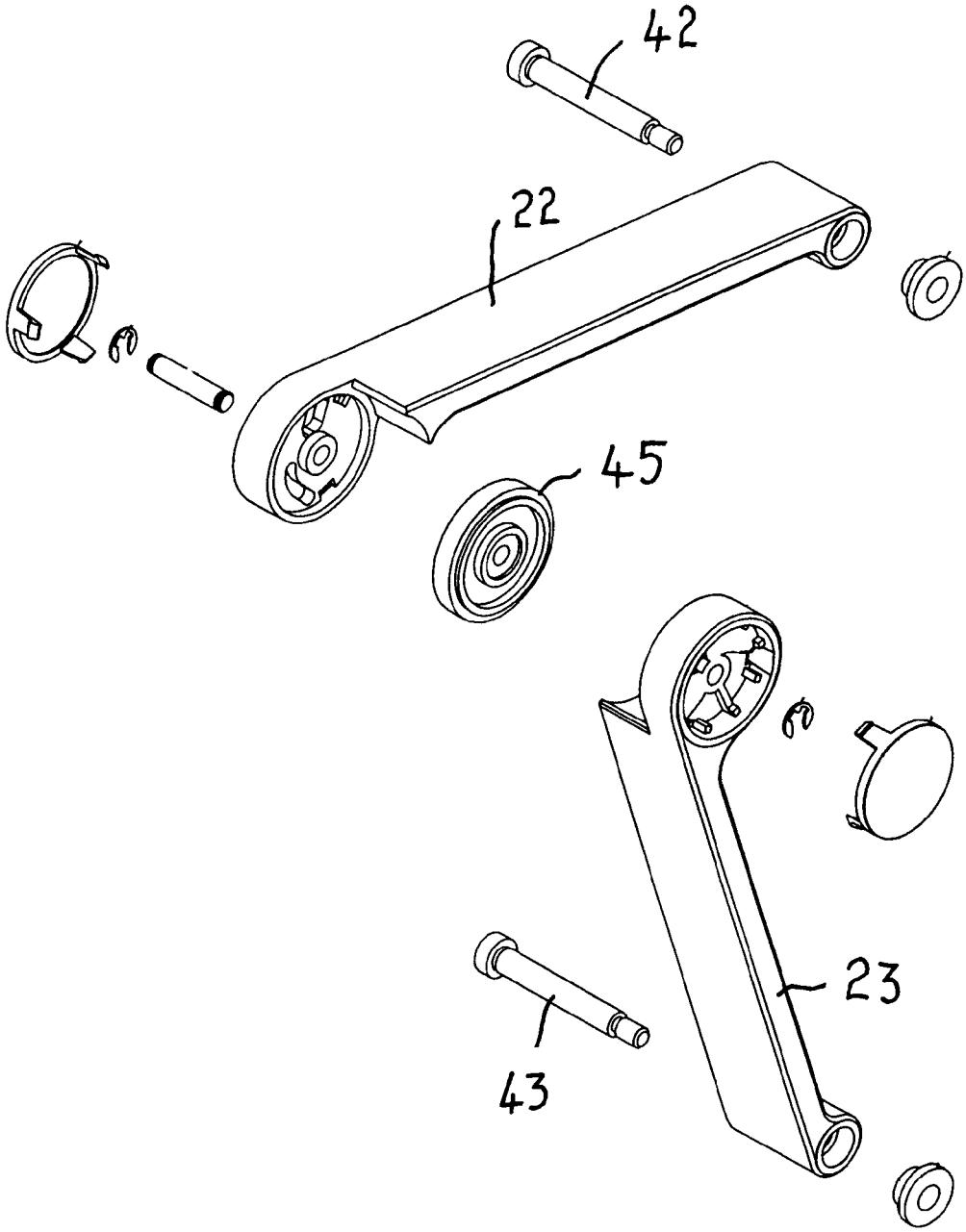
FIG. 8 is a further exploded perspective view of the single armrest illustrated in FIG. 7.

As illustrated in FIG. 8, the connection 40 utilizes a generally disc-shaped pivot spacer 45 to maintain the desired spacing relationship between the arm support 22 and support brace 23.

Turning now to FIGS. 10-18, a second embodiment of the present invention is illustrated. Here the armrest on the right hand of the person to sit in the chair 10, is provided with a cup holder 145 which enables a cup to be retained adjacent to each chair 10 for the benefit of patrons. Typically food vendors sell beverages, chips (or French fries as they are known in the USA), popcorn, and the like in such cups.

Figure 14:
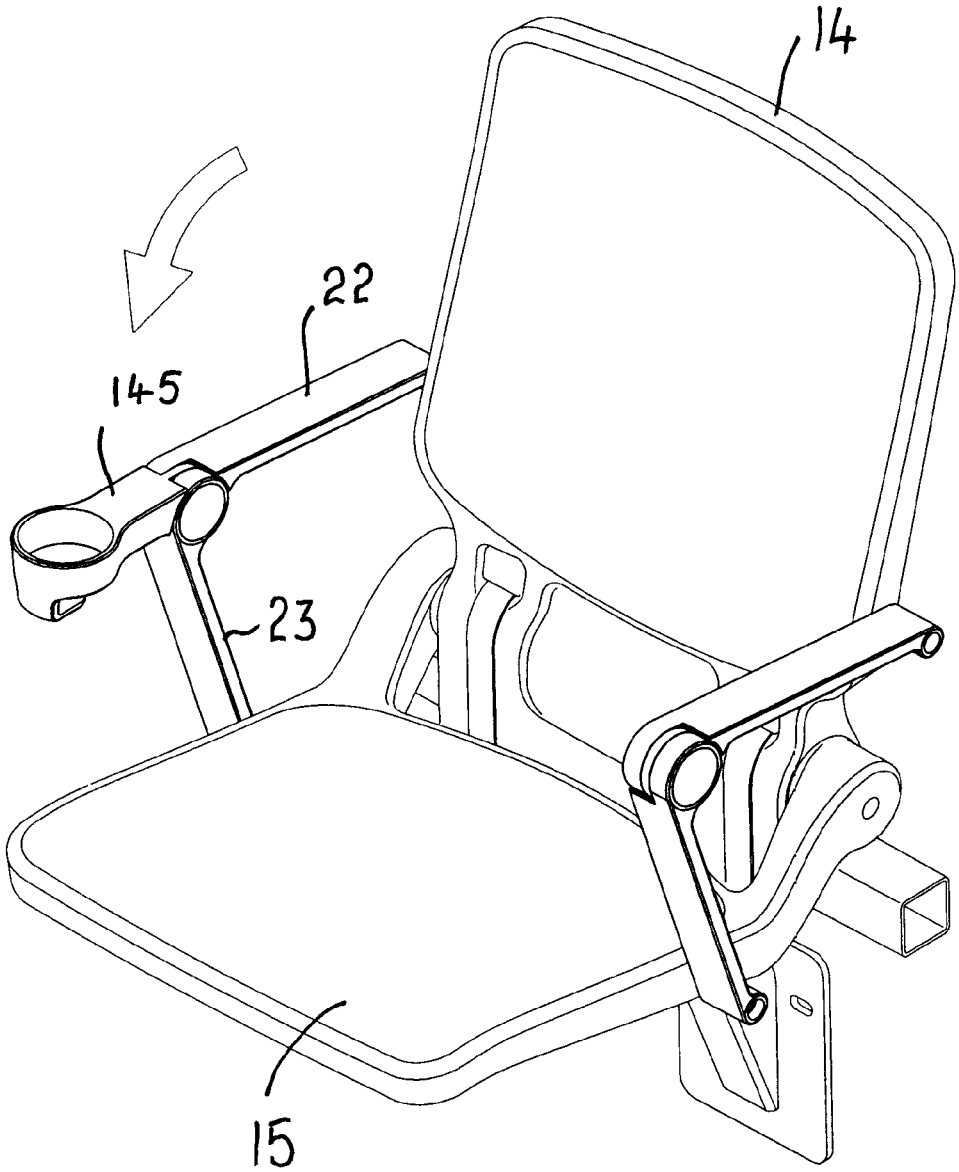
Figure 15:
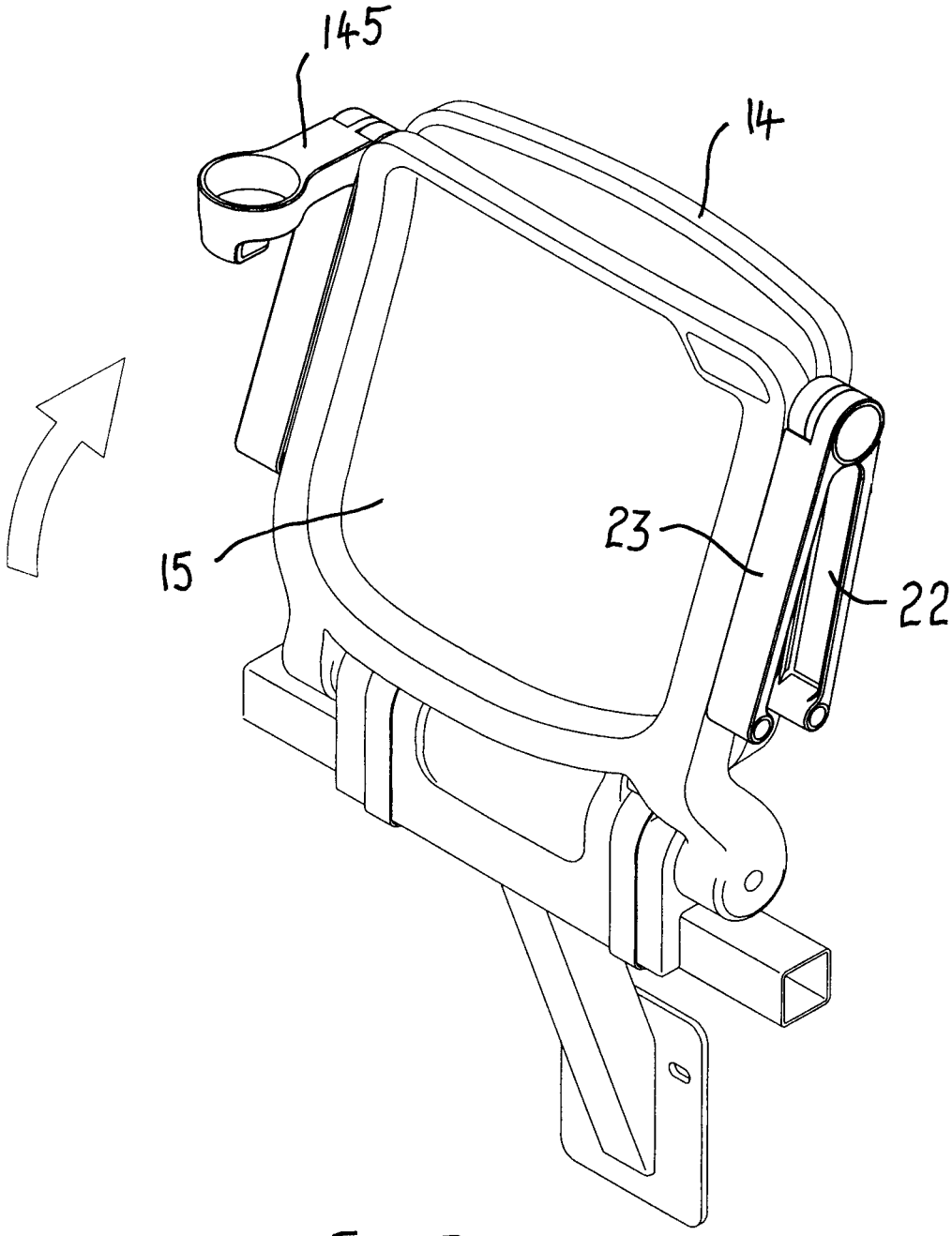
Figure 16:
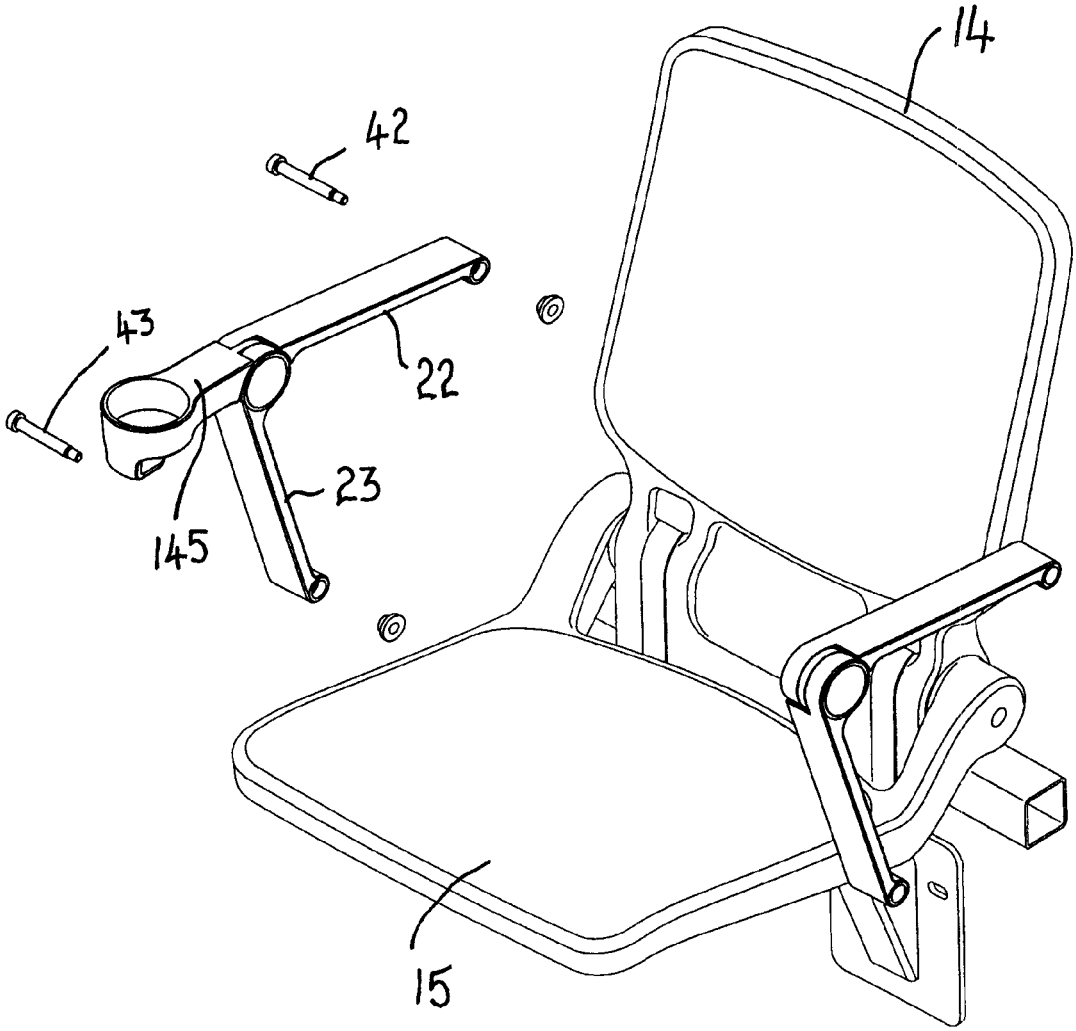

The chair 10 in FIG. 15 shows the seat 15 raised and the armrest 21 in the stowed position, whilst illustrated in FIG. 14 is the seat 15 in the lowered use position and the armrest 21 in the deployed position.

It will be apparent to those skilled in the art that the armrest 21 can be moved between the stowed and deployed positions, and vice versa, without tilting the cup holder 145. Thus spills both unintentional and intentional are avoided.

Figure 17:
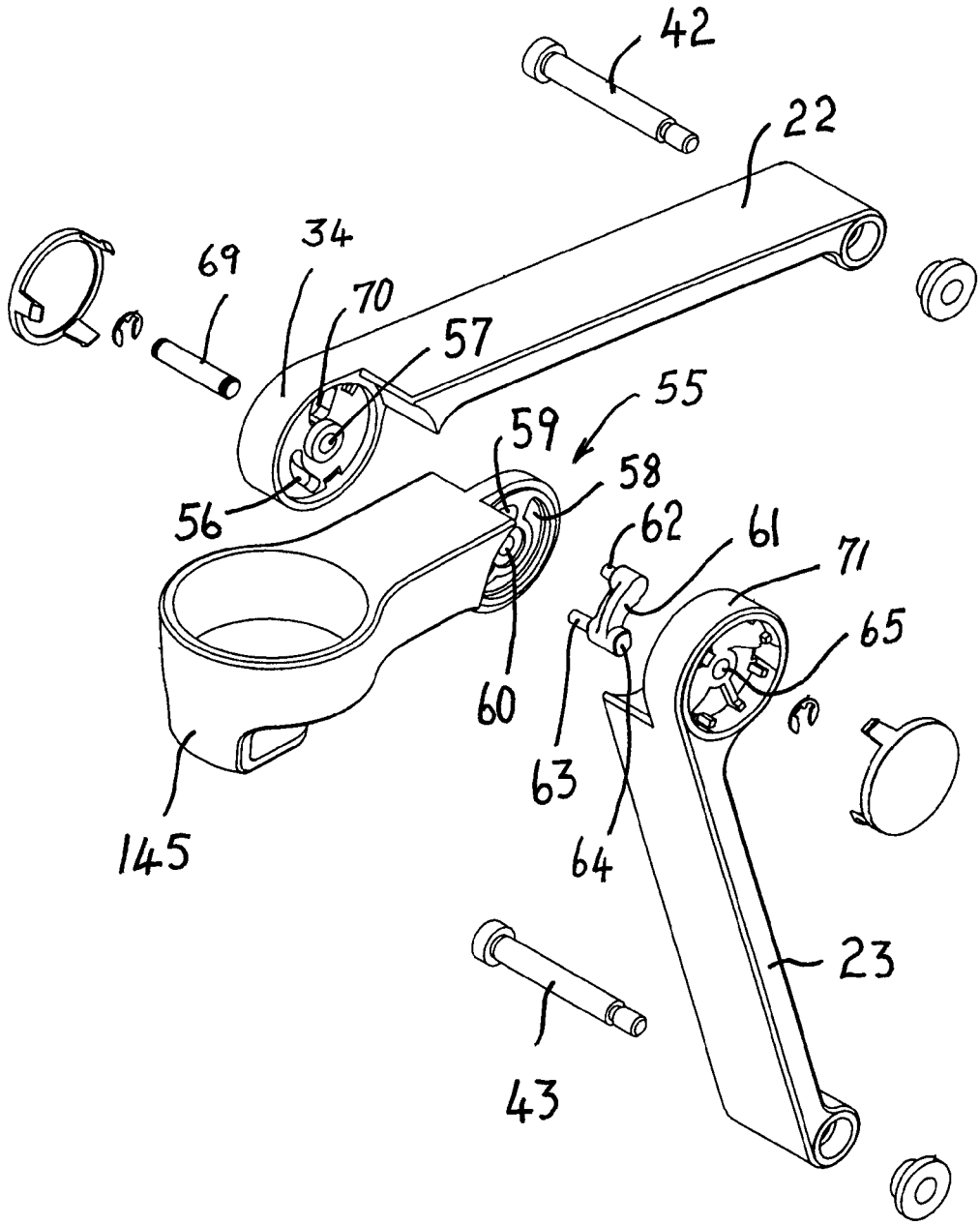
Figure 18:
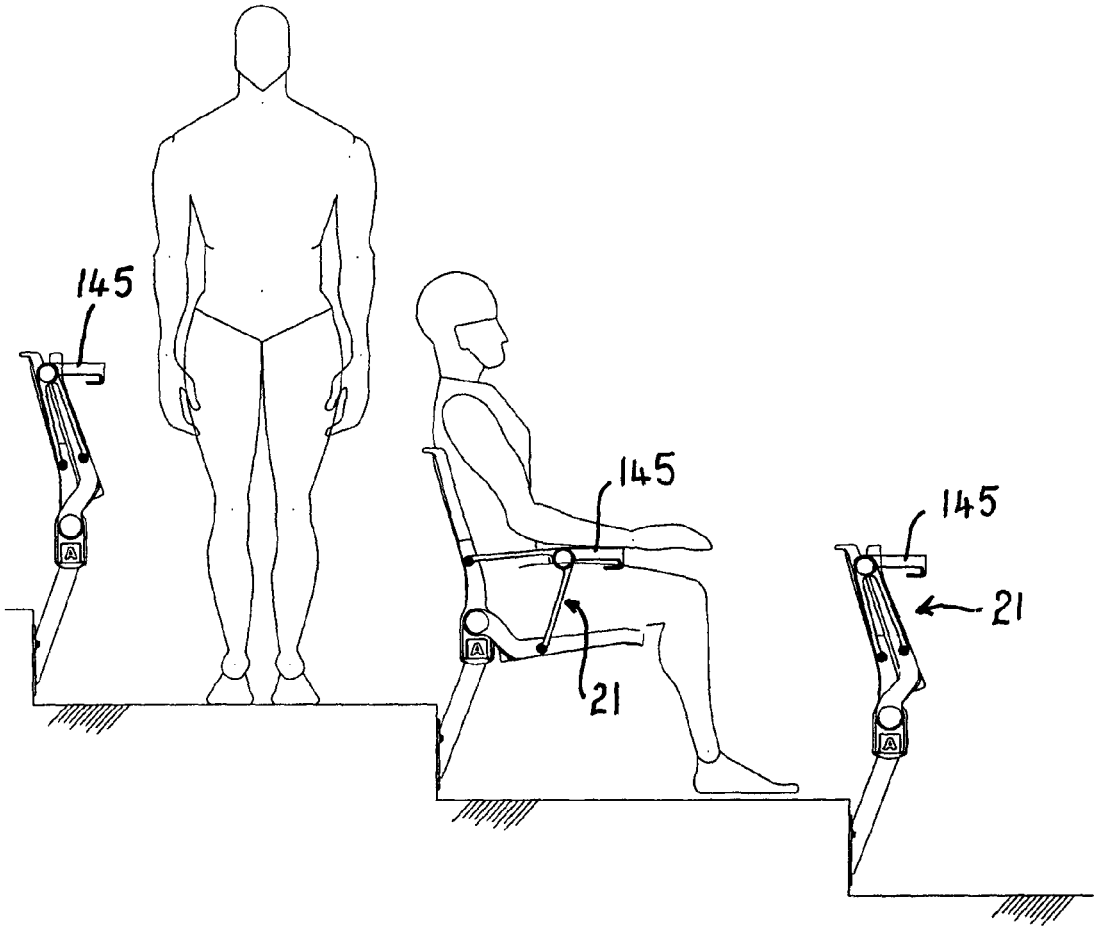

Turning now to FIG. 17, how this desirable result is brought about will now be explained. It will be appreciated that the pivot spacer 45 of the first embodiment is replaced by the cup holder 145 of the second embodiment. The cup holder 145 includes a disc 55. The forward end 34 of the arm support 22 includes an arcuate slot 56 and a central aperture 57. The disc 55 includes two part circular slots 58 and 59 of unequal length and a central opening 60. The part circular slot 58 has a longer length, or greater angular extent, than the slot 59. An axle 69 passes through the central aperture 57, and central opening 60 and through a central opening 65 in the upper end of the support brace 23. Two circlips retain the axle 69.

A cam 61 has two pins 62 and 63 of unequal length. The shorter pin 62 is received in the longer part circular slot 58 and extends into the recess 70. The longer pin 63 passes through the part circular slot 58 and is received by the arcuate slot 56. The cam also includes a boss 64 which mates with a recess (not illustrated) in the top 71 of the support brace 23.

Figure 10:
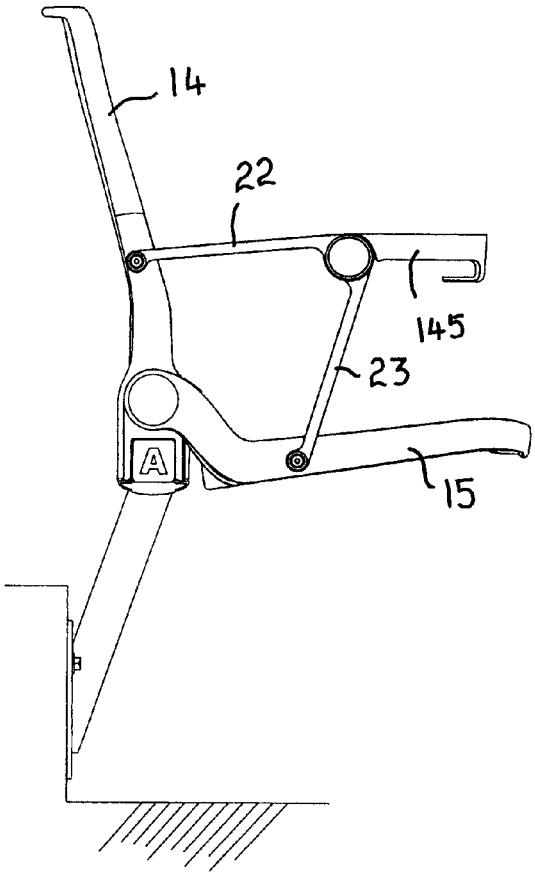
Figure 11:
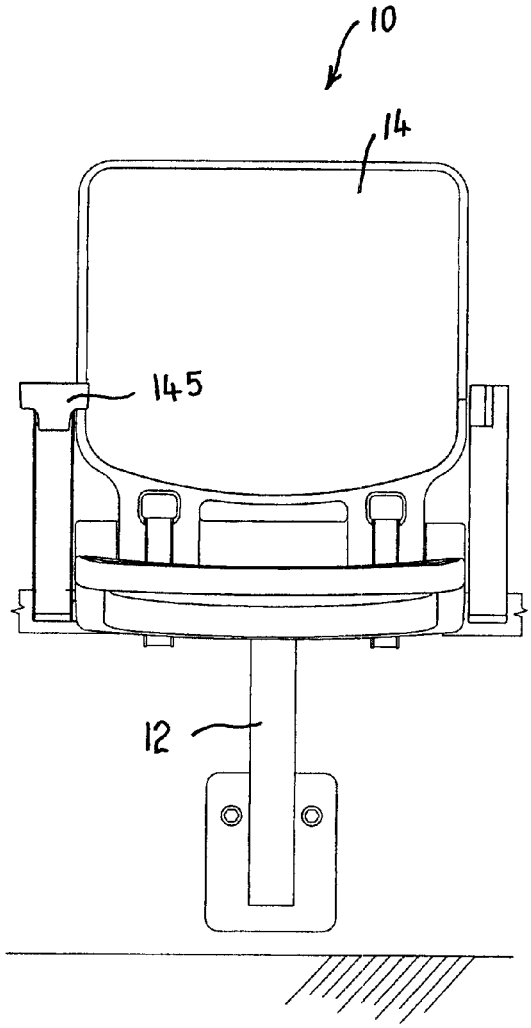
Figure 12:
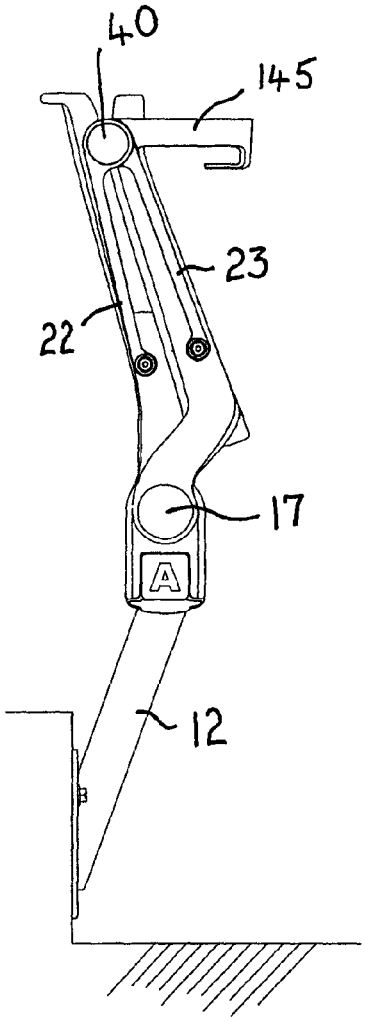
Figure 13:
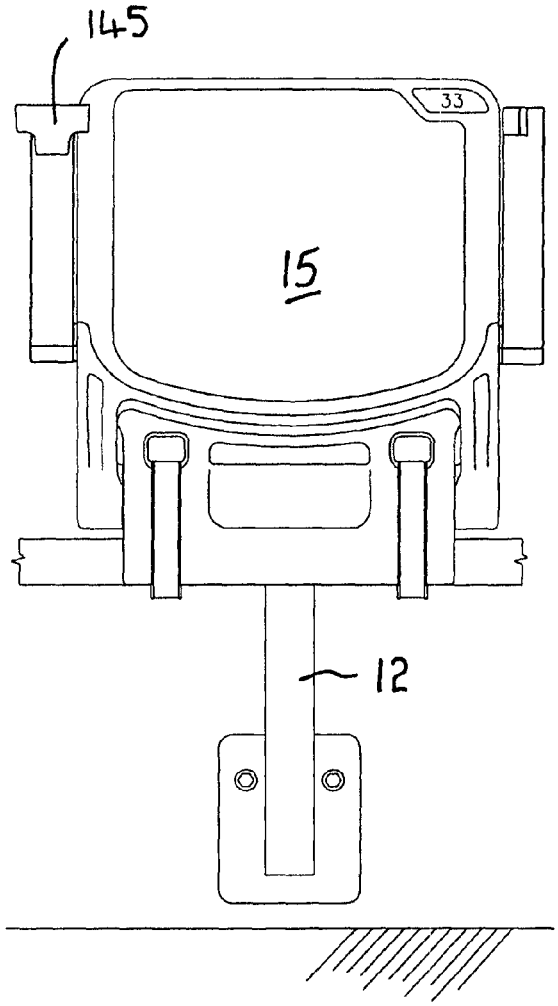

As the arm support 22 rises in moving from the generally horizontal position illustrated in FIG. 10, to the just past vertical position illustrated in FIG. 12, so the forward end 34 tends to rotate clockwise whilst the top 71 rotates anticlockwise. During this movement the arcuate slot 56 moves relative to the longer pin 63. The pin 63 moves to the left hand end of slot 59 and therefore drives the cup holder 145 anticlockwise relative to the arm support 22. This maintains the cup holder 154 substantially level. Movement of the arm support 22 downwardly results in the reverse of the above described motion but again the cup holder 145 remains substantially level. The lengths of the arcs of slots 56, 58 and 59 are selected to enable this motion.

The foregoing describes only two embodiments of the present invention and modifications, obvious to those skilled in the furniture arts, can be made thereto without departing from the scope of the present invention. For example, the armrest 21 can accommodate power and communications cords and outlets. Similarly, the arm support 22 can be padded.

The term "comprising" (and its grammatical variations) as used herein is used in the inclusive sense of "including" or "having" and not in the exclusive sense of "consisting only of".

The invention claimed is:

1. A pivotal armrest for seating arranged in rows and having a stationary backrest and a seat pivotable between a generally horizontal use position and a generally vertical standby position, said armrest comprising an arm support and a supporting brace each of which has two ends, a first one of said arm support ends being pivotally connectable to one side of said backrest at a location above the axis of pivot of said seat, a first one of said supporting brace ends being pivotally connectable to the same side of said seat at a location thereon spaced from said seat pivot axis, and the second ends of said arm support and said supporting brace being pivotally connected together, the lengths of said arm support and said supporting brace and the distance between said seat pivot axis and said locations being selected such that with said seat pivoted into said use position said armrest support is substantially horizontal and said supporting brace is inclined forwardly, and with said seat pivoted into said standby position said arm support and said supporting brace lie alongside each other and are generally vertical and said arm rest having a cup holder pivotally connected to the pivotal interconnection of said second ends; and said cup holder being substantially horizontal and remaining substantially horizontal irrespective of the motion of said seat between said use and standby positions.

2. The armrest as claimed in claim 1 wherein said backrest is slightly rearwardly inclined and said arm support and supporting brace when lying alongside each other are inclined slightly rearwardly to the same extent as said backrest.

3. The armrest as claimed in claim 2 wherein with said seat in said standby position the distance from the rear surface of said backrest to the underside of said seat exceeds the transverse extent of said arm support and said supporting brace lying alongside each other.

4. The arm rest as claimed in claim 1 wherein said cup holder includes a cam mechanism which drives the cup holder in a direction opposite to the motion of said arm support.

5. A method of moving an armrest between stowed and deployed positions, said method comprising the steps of:

(i) providing an arm support and a supporting brace each having two ends, (ii) pivoting one end of said arm support to one side of a backrest, (iii) pivoting one end of said supporting brace to the same side of a seat pivoted to said backrest and movable between a generally horizontal use position and a generally vertical standby position, (iv) pivotally interconnecting the second ends of said arm support and said supporting brace, (v) pivotally connecting a cup holder to the interconnection of said second ends, and (vi) maintaining the orientation of said cup holder generally horizontal irrespective of the motion of said seat between said use and said standby positions.

* * * * *